US005349164A

United States Patent [19]

Ohta

[11] Patent Number: 5,349,164

[45] Date of Patent: Sep. 20, 1994

[54] COOKING APPLIANCE WITH MULTIFUNCTION KNOBS

[75] Inventor: Nobuaki Ohta, Aichi, Japan

[73] Assignee: Kabushiki Kaisha Toshiba, Kawasaki, Japan

[21] Appl. No.: 58,267

[22] Filed: May 10, 1993

[30] Foreign Application Priority Data

May 27, 1992 [JP] Japan ..... 4-134934
May 29, 1992 [JP] Japan ..... 4-138559

[51] Int. Cl.[5] ..... H05B 6/68

[52] U.S. Cl. ..... 219/506; 219/715; 219/720; 219/719; 99/325

[58] Field of Search ..... 219/10.55 B, 10.55 R, 219/10.55 E, 506, 492, 493, 715, 719, 720, 702; 99/325

[56] References Cited

U.S. PATENT DOCUMENTS 3,582,167 6/1971 Lear ..... 312/7
4,324,966 4/1982 Tanabe ..... 219/10.55 B
4,430,540 2/1984 Scalf ..... 219/10.55 B
4,625,086 11/1986 Karino ..... 219/10.55 B
4,713,801 12/1987 Hale ..... 369/7

FOREIGN PATENT DOCUMENTS 3129802 2/1983 Fed. Rep. of Germany .
4008827 9/1991 Fed. Rep. of Germany .

*Primary Examiner*—Philip H. Leung
*Attorney, Agent, or Firm*—Cushman, Darby & Cushman

[57] ABSTRACT

An automatic cooking appliance has a magnetron to cook the food. The cooking appliance has a dial, which is rotatable and capable of being pressed, on an operation panel thereof. A cooking mode in the menu is selected due to the rotation of the dial. The cooking mode is determined by pressing of the dial. The cooking appliance controls the magnetron in accordance with the determined cooking mode. This enables the dial to be used for multiple purposes to thereby save space on a control panel.

8 Claims, 6 Drawing Sheets

COOKING APPLIANCE WITH MULTIFUNCTION KNOBS

BACKGROUND OF THE INVENTION

The present invention relates to a cooking appliance.

A prior cooking appliance, for example, a microwave oven, has many cooking modes to cook food. The cooking appliance has many keys on a front panel thereof. Each key corresponds to one cooking mode. When a user selects one of the cooking modes by pressing the key, the cooking appliance automatically cooks food in accordance with the selected cooking mode.

The more the number of the cooking modes increase, the more the number of the keys increase. Therefore, much space is required for the keys in the front panel of the prior cooking appliance.

One cooking appliance has fewer keys on the front panel thereof. There is a display which indicates a cooking mode selected by the key. When the user presses the same key repeatedly, the cooking mode selected by the key is changed on the display. In this cooking appliance, the user must press the key repeatedly. Therefore, the selection of the cooking mode is annoying and inconvenient for the user.

SUMMARY OF THE INVENTION

It is an object of the present invention to provide a cooking appliance which can minimize the space and the number of keys to select the cooking mode.

It is another object of the present invention to provide a cooking appliance which can select the cooking mode easily.

In order to achieve the above objects of the present invention, there is provided a cooking appliance comprising:

a) heating means for heating food;

b) an actuator having two kinds of function of actuation a cooking mode to be chosen from plural modes in a menu, being set by the first actuation of the actuator and the set cooking mode being determined by the second actuation of the actuator; and c) means, responsive to the first and second actuation of the actuator, for setting the cooking mode in plural kinds of menu based on the first actuation of the actuator, for determining the set cooking mode based on the second actuation, for controlling the heating means based on the determined cooking mode.

The present invention also contemplates a method according to the above.

DESCRIPTION OF THE PREFERRED EMBODIMENTS

Figure 1:
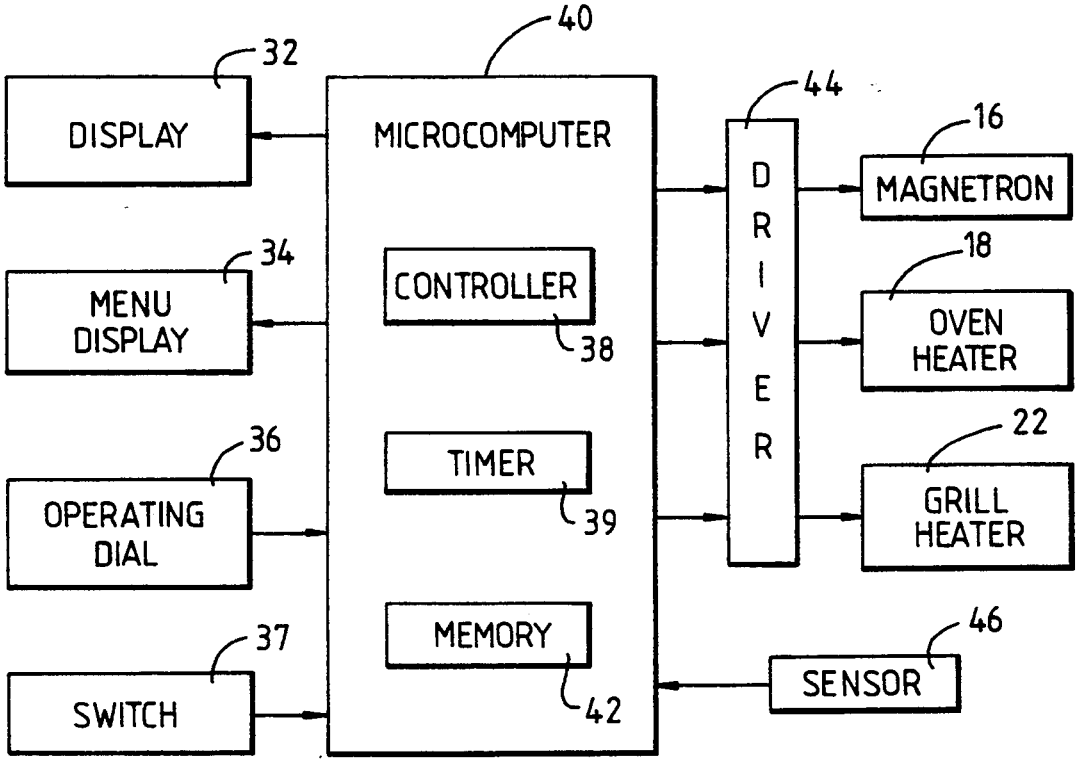
FIG. 1 is a block diagram showing an electrical arrangement of a cooking appliance including a first embodiment of the present invention.

A first embodiment, in which the present invention is applied to a microwave oven with an automatic cooking function, will be described with reference to the drawings.

A microwave oven 10 has a cooking chamber 12 for receiving food to be cooked. A machinery chamber 14 is provided on a side of the cooking chamber 12. A magnetron 16, as heating means which heats the food in the cooking chamber 12, is located in the machinery chamber 14. An oven heater 18, which is used in an oven cooking, is located out of a rear wall 20 of the cooking chamber 12. A grill heater 22, which is used in a grill cooking, is located on a ceiling 24 of the cooking chamber 12. A front door 26, which opens and closes the cooking chamber 12, is pivotally mounted on a front surface 28 of the microwave oven 10. An operation panel 30 is provided on the front surface 28 in front of the machinery chamber 14. A display 32, which is located on the operation panel 30, displays a time and a state of a set cooking mode. A menu display 34, which is also located on the operation panel 30, displays a menu including a lot of cooking modes.

The menu display 34 comprises three menu portions 34*a*, 34*b* and 34*c* which display plural cooking modes in the menu respectively. When a cooking mode in the menu is selected, the set cooking mode and one of the menu portions 34*a*, 34*b* and 34*c* in accordance with the set cooking mode are lighted up respectively. An operating dial 36 as an actuator, which is rotatable in both directions and also capable of being pressed, is located on the bottom portion of the operation panel 30. The rotating actuation of the operating dial 36 is a first actuation, and the pressing actuation is a second actuation.

The operating dial 36 outputs a signal, which is accordance with both of the direction of the rotation thereof and the rotation angle, to a controller 38. A desired cooking mode in the menu on the menu display 34 is selected and set by the outputted signal. When the operating dial 36 is pressed, a signal for starting the cooking is sent to the controller 38.

Three switches 37 allow selection of a kind of cooking among heat cooking, oven cooking and grill cooking. Switches 37 are provided under the operating dial 36. The user can set a cooking time using the rotating amount of the operating dial 36.

A microcomputer 40 comprises the controller 38, a timer 39, and a memory 42 which in advance stores a cooking program including, for example, a cooking time and a kind of cooking. When the user uses the menu display 34, the microwave oven 10 automatically cooks the food on the basis of the program in the memory 42 in accordance with the cooking mode set by the user in the menu display 34.

The magnetron 16, the oven heater 18, and the grill heater 22 are respectively connected to the microcomputer 40 through a driver 44. A sensor 46, for example, a gas sensor and a thermistor, which can detect a state of cooking, is also connected to the microcomputer 40.

Figure 4:
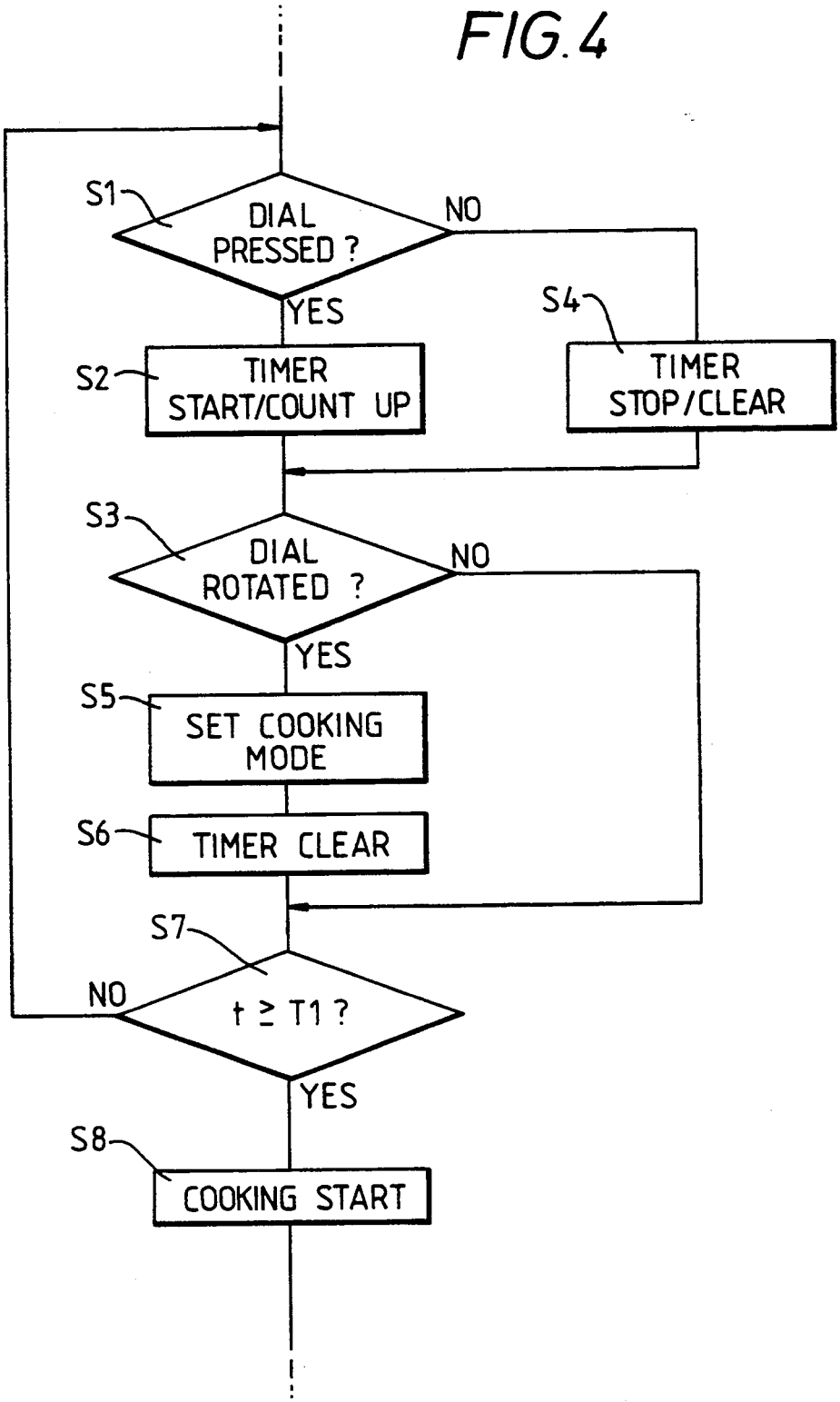
FIG. 4 is a flow chart showing an operation of the cooking appliance including the first embodiment.

An operation of the first embodiment will be described with reference to FIG. 4 to FIG. 6.

In the case of selecting the automatic cooking, firstly, the user rotates the operating dial 36 to select a cooking mode among the plural cooking modes in the menu display 34. When the user rotates the operating dial 36 clockwise, a pulse due to the rotation of the operating dial 36 is sent to the controller 38. The controller 38 detects both of the direction and the amount of the rotation of the operating dial 36. Since the direction is clockwise, one of the menu portions 34*a*, 34*b*, and 34*c* is lighted up in order on the basis of the amount of the rotation. When the operating dial 36 stops rotating, one of the menu portions, for example 34*a*, is set and is lighted up.

Next, the user rotates the operating deal 36 counterclockwise. A pulse due to the rotation of the operating dial 36 is again sent to the controller 38. The controller 38 detects both of the direction and the amount of the rotation of the operating dial 36. Since the direction is counterclockwise, one of the cooking modes, for example, RICE, is lighted up in the menu portion 34*a* in a different color from the menu portion 34*a*.

Thus, the cooking mode "RICE" is selected and set. The controller 38 reads the program in the memory 42 in accordance with the cooking mode "RICE", and sets the program. After that, the controller 38 counts a time while the dial is being pressed continuously. When the time exceeds a predetermined time T1, the controller 38 starts the set program, that is, the microwave oven 10 actuates the magnetron 16 to heat the rice.

Therefore, since all user functions are programmed using operating dial 36, the microwave oven 10 can minimize the space for the keys and the number of the keys to select the cooking mode.

Moreover, the user can select the cooking mode easily.

This will be described in more detail with reference to FIG. 4. The microcomputer 40 determines whether the operating dial 36 is being pressed (step S1). In the case of "YES" at the step S1, the timer 39 either starts to count (if the timer is stopped), or continues the counting up (when the timer is already counting) (step S2). In the case of "NO" at the step S1, the timer 39 stops counting and the count of the timer 39 is cleared (step 4). The microcomputer 40 determines whether the operating dial 36 rotates, that is, a pulse is inputted to the microcomputer 40 due to the rotation of the operating dial 36. In the case of "YES" at the step S3, the microcomputer 40 sets a cooking mode on the basis of the pulse caused by the rotation of the operating dial 36 (step S5). The count of the timer 39 is cleared (step S6). The microcomputer 40 determines whether the time of the timer 39 exceeds a predetermined value T1, for example, 0.3 second (step S7). Also, in the case of "NO" at the step S3, the flow progresses to the step S7. In the case of "NO" at the step S7, the flow returns back to the step S1. While the flow repeats between the step S1 to the step S7, when the result is "YES" at the step S7, the microwave 10 starts the cooking based on the set cooking mode.

Figure 5:
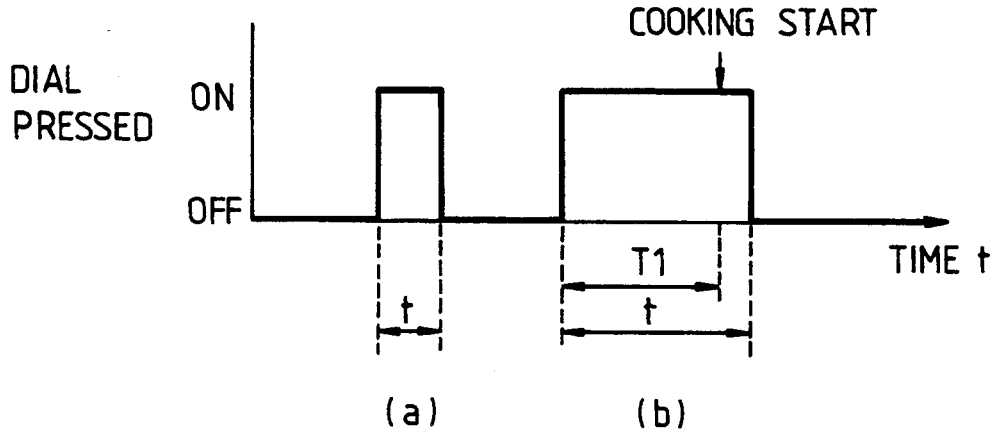
FIG. 5 is a timing chart of a signal corresponding to a second actuation of an actuator of the cooking appliance including the first embodiment.
Figure 6:
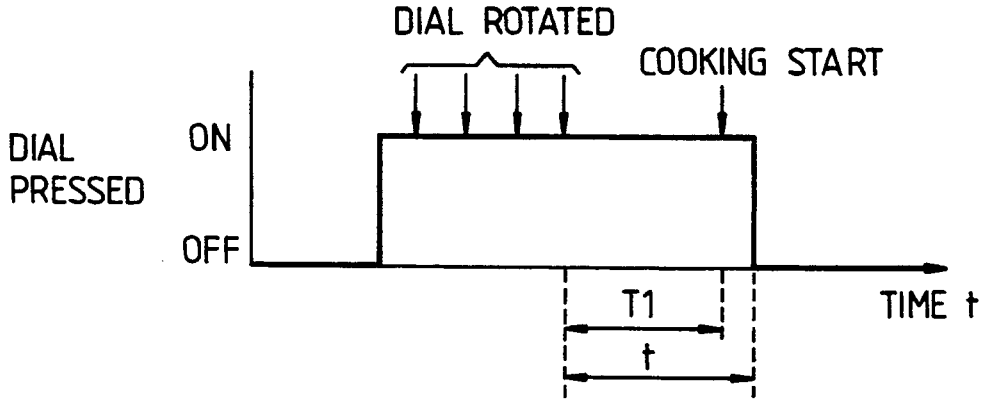
FIG. 6 is a timing chart corresponding to the FIG. 5 when a first actuation of the actuator is operated during an operation of the second actuation of the cooking appliance including the first embodiment.

That is, as shown in FIG. 5, when the operating dial 36 is being pressed, the timer 39 increases the count, that is, time t. Before the time t exceeds the predetermined value T1, however, if the pressing of the operating dial 36 is stopped, the microcomputer 40 stops the counting of the timer 39 and clears the time t. As a result, the microwave oven 10 does not start the cooking as shown by waveform a in FIG. 5.

On the other hand, when the operating dial 36 is being pressed continuously for a time longer than the predetermined value T1, the microwave oven 10 starts cooking as shown in waveform b of FIG. 5.

Therefore, if the user presses the operating dial 36 by accident for an instant, the microwave oven 10 does not start cooking.

While the user is continuously pressing the operating dial 36, when the user rotates the operating dial 36, the time t is cleared. When the rotation of the operating dial 36 stops, the timer 39 starts the counting again in the state of being pressed of the operating dial 36 also. When the time t of the timer 39 exceeds the predetermined value T1, for example, 0.3 second, the microwave oven 10 starts cooking.

Therefore, regardless of by user's will or by accident, after the user set the first cooking mode, in the condition of the count being within the predetermined period T1, the user can set the second cooking mode again without detaching his hand from the operating dial 36. The microwave oven 10 is hence convenient for a user to use.

In the first embodiment, the menu display 34 has three menu portions 34*a*, 34*b* and 34*c*, however, the scope of the invention is not restricted to the first embodiment. For example, another way in which the cooking mode is displayed in order due to the rotation of the operating dial uses slidable actuator in a linear direction instead of the rotatable operating dial.

Figure 2:
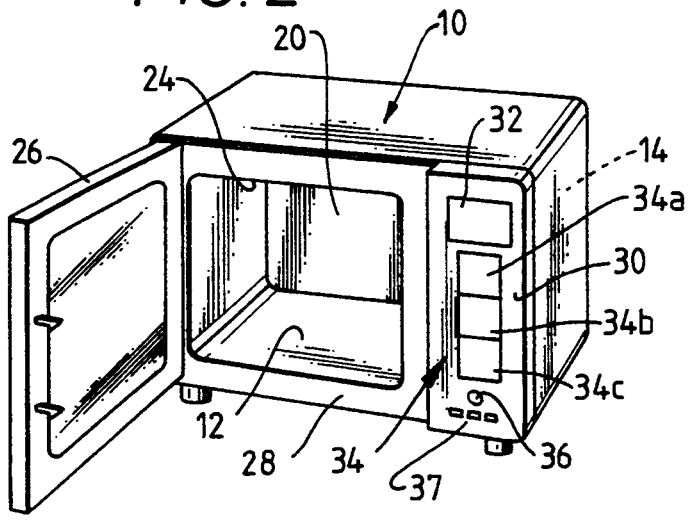
FIG. 2 is a perspective view of the cooking appliance including the first embodiment.
Figure 3:
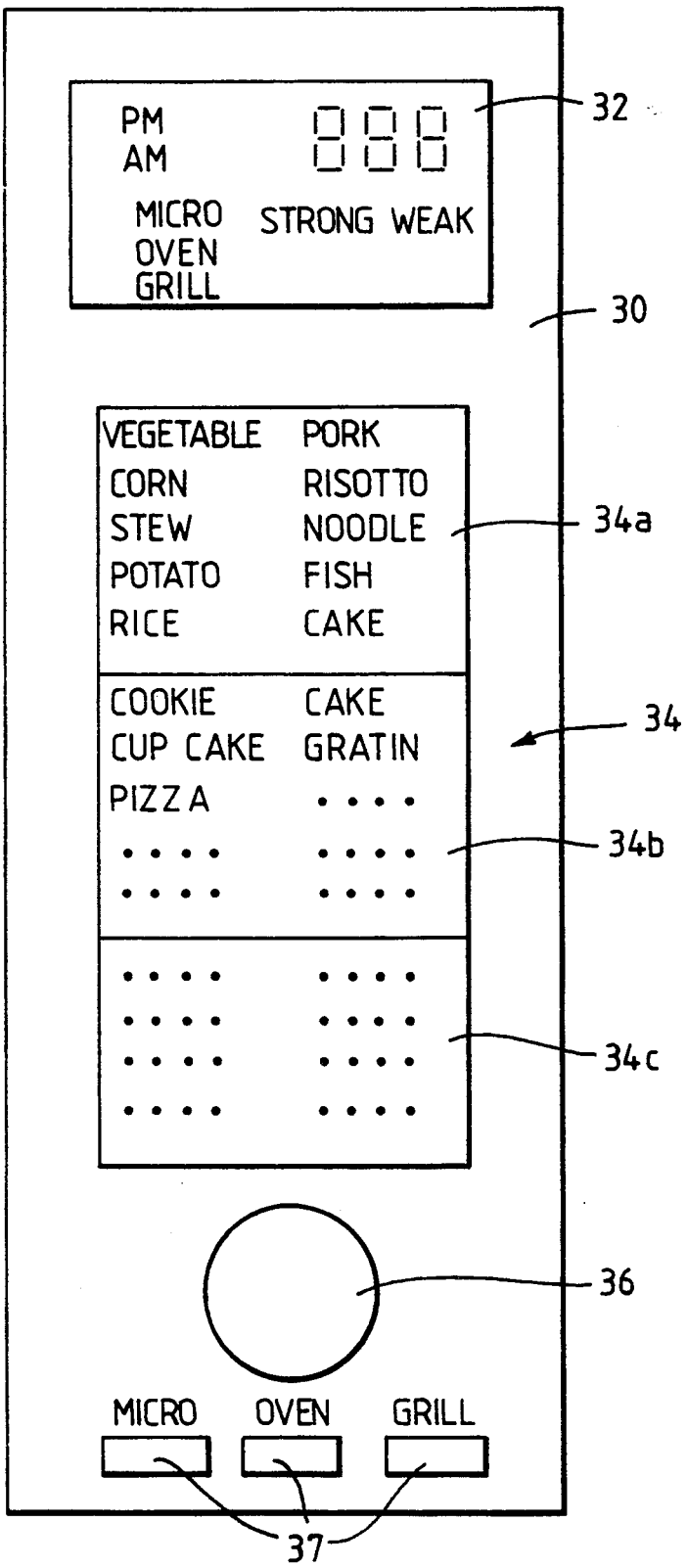
FIG. 3 is a front view of a front panel of the cooking appliance including the first embodiment.
Figure 7:
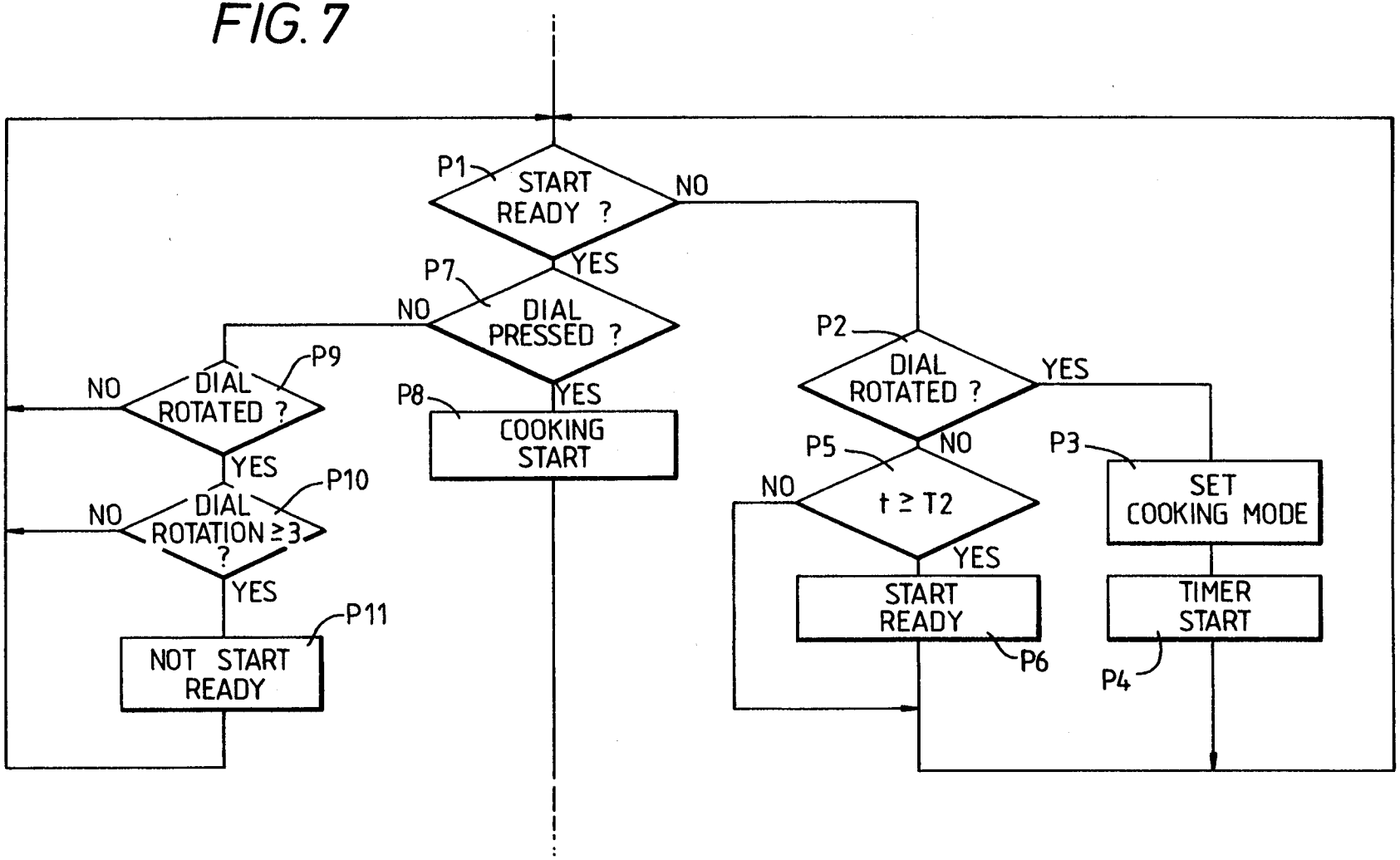
FIG. 7 is a flow chart showing an operation of the cooking appliance including a second embodiment of the present invention.
Figure 8:
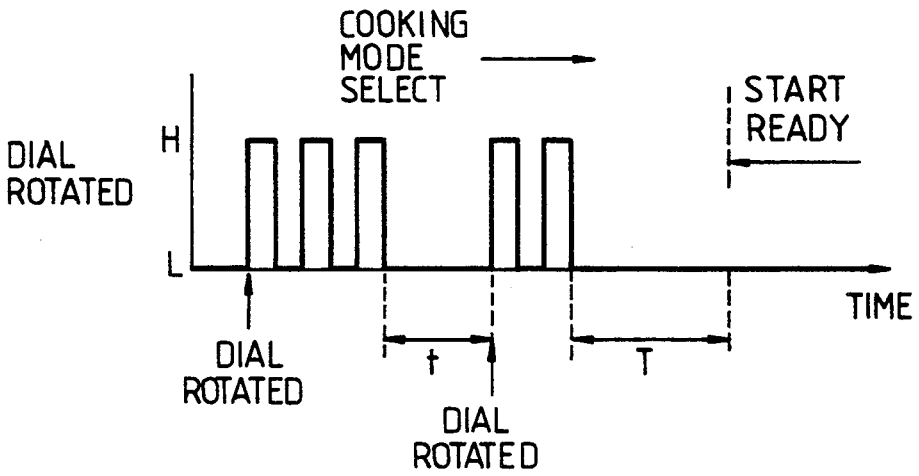
FIG. 8 is a timing chart of a signal corresponding to a first actuation of the cooking appliance including the second embodiment.
Figure 9:
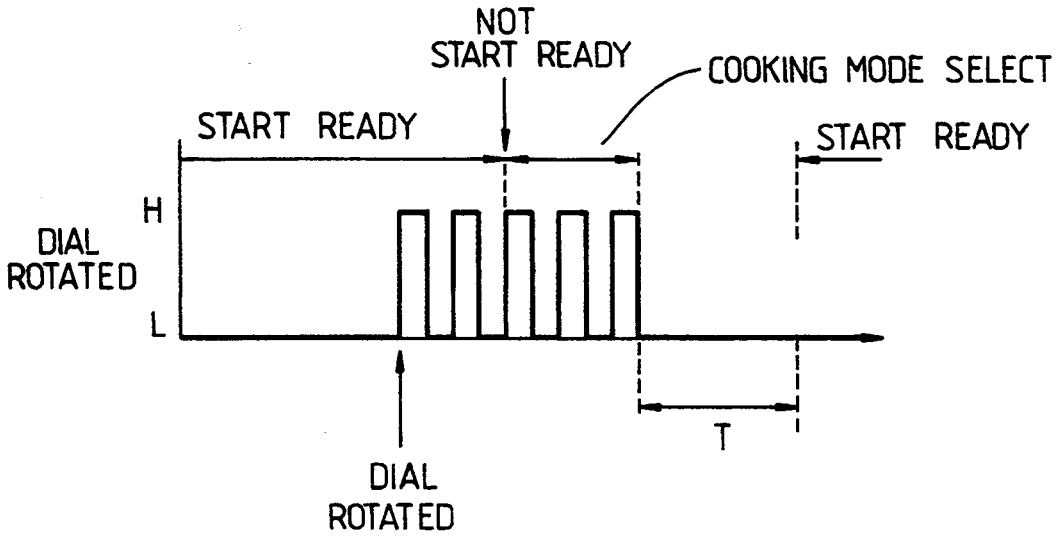
FIG. 9 is a timing chart, corresponding to the FIG. 8 in the state where a cooking initiation is accepted, of the cooking appliance including the second embodiment.

FIG. 7 to FIG. 9 show the second embodiment of this invention. A construction of the second embodiment is same as that of the first embodiment as shown in FIG. 1 to FIG. 3.

Only the operation of the second embodiment which differs from the first embodiment will be described. The user rotates the operating dial 36 to select a cooking mode among plural cooking modes in the menu display 34 in same way as in the first embodiment. When the cooking mode is selected, the microcomputer 40 reads a program, according to the rotation value and the direction of the operating dial 36, from the memory 42. When the operating dial 36 is not rotated for a predetermined period T2, for example, 0.3 seconds, the microcomputer 40 can accept the information of the pressing of the operating dial 36 to start the cooking (START READY).

As a result, after the predetermined period T2, when the operating dial 36 is pressed, the microwave oven 10 starts its cooking.

If during the predetermined period T2 user rotates the operating dial 36, the microcomputer 40 sets again the cooking mode on the basis of the pulse in accordance with the rotation of the operating dial 36.

A situation in which the user operates the dial after the predetermined time T2, will be described as follows.

The microcomputer 40 determines whether the microcomputer 40 can accept the information to start the cooking (step P1), that is, whether the operating dial 36 is not rotated for the predetermined period T. When the user is rotating the operating dial 36 to select the cooking mode, since the computer 40 cannot accept the information, that is, start is not ready, the microcomputer 40 determines "NO" at the step P1. The microcomputer 40 determines whether the operating dial 36 is rotated, that is whether a pulse generated by the rotation of the operating dial 36 is inputted to the microcomputer 40 (step P2). In the case of "YES" at the step P2, the cooking mode is changed at every pulse of the operating dial 36 (step P3). A timer 39 starts the counting to count the time t until there is a next rotation of the operating dial 36 (step P4) and the flow returns back to the step P1. After the timer 39 starts, before the time t of the timer reaches the predetermined period T2, the microcomputer 40 determines "NO" at the step S1. When the operating dial 36 is not rotated, the microcomputer 40 determines "NO" at the step P2, and the flow progresses to a next step P5. Before the time t of the timer 39 also reaches the predetermined period T2, the flow returns back to the step P1. While the flow repeats the steps, when the time t of the timer 39 reaches the predetermined period T2, the flow progresses to a next step P6. At the step P6, the microcomputer 40 enters a state capable of accepting the information of starting the cooking. Then start is ready, and the flow returns back to the step P1. That is, at that time, when the operating dial 36 is pressed, the microwave oven 10 starts the cooking.

In the case of "YES" at the step P1, the flow progresses to a next step P7. The microcomputer 40 determines whether the operating dial 36 is pressed at the step P7. In the case of "YES" at the step P7, the flow progresses to a next step P8. At the step P8, the microcomputer 40 drives and controls the magnetron 16, oven heater 18, or the grill heater 22 in accordance with the cooking mode selected by the user.

If the result of step P7 is "NO", the flow progresses to a next step P9. When the operating dial 36 is not rotated at the step P9, the microcomputer 40 determines "NO", and the flow returns back to the step P1. In the case of "YES" at the step P9, that is, when the operating dial 36 is rotated, the flow progresses to a next step P10.

At the step P10, the microcomputer 40 determines whether the rotation of the operating dial 36 exceeds a predetermined range, that is, for example, a number of pulses generated by the rotation of the operating dial 36 exceeds three. In the case of "YES" at the step P10, the microcomputer 40 does not allow acceptance of the information to start the cooking, and the flow returns back to the step S1. In the case of "NO" at the step S10, the flow returns back to the step S1. FIG. 6 shows the state of a signal generated by the rotation of the operating dial 36.

After the user selects and sets a cooking mode, and the user presses the operating dial 36 to start the cooking, if the user rotates the operating dial 36 a little bit by accident, the rotational degree does not reach the predetermined value. This is because there will always be fewer than three pulses. As a result, the microcomputer 40 determines "NO" at the step P10, and the flow returns back to the step P1.

Therefore, after that, when the user presses the operating dial 36, the microcomputer 40 determines "YES" at the step P7 through the step P1, and the microwave oven 10 starts its cooking in the step P8.

According to the second embodiment, even if the operating dial 36 is rotated by a little by accident when the user presses the operating dial 36, the selected cooking mode is not changed, and remains ready for start. Therefore, it is very convenient for user to use the microwave oven.

Although only a few embodiments have been described in detail above, those having ordinary skill in the art will certainly understand that many modifications are possible in the preferred embodiment without departing from the teaching therefor. For example, although the embodiment describes selection by rotation in two directions, of course this selection could be done using rotation in only one direction.

All such modifications are intended to be encompassed within the following claims.

What is claimed is:

1. A cooking appliance comprising:

a) heating means for heating food;

b) an actuator having at least two kinds of function of actuation, a first actuation selecting a cooking mode among plural kinds of cooking modes in a menu, and a second actuation commanding that the selected cooking mode be started; and c) means, responsive to the first and second actuations of the actuator, for setting the cooking modes in plural kinds of menus based on the first actuation of the actuator, for determining the set cooking mode only when the second actuation being maintained for a first predetermined period greater than a shortest possible actuation duration unless the first actuation is performed again during the first predetermined period, in which case the controlling means setting a second cooking mode which is again set by the first actuation, the controlling means determining the second cooking set mode based on the second actuation being maintained for a second predetermined period from a point when the first actuation is performed again, for controlling the heating means based on the second determined cooking mode.

2. A cooking appliance according to claim 1, further including a display, the cooking mode set by the first actuation being displayed on the display.

3. A cooking appliance according to claim 1, wherein the first predetermined period is the same as the second predetermined period.

4. A cooking appliance according to claim 1, wherein the controlling means determines the second set cooking mode when the first actuation is performed only beyond a predetermined range again during the first predetermined period.

5. A cooking appliance according to claim 1, wherein the actuator includes a button switch, and the first actuation of the button switch includes a rotating actuation, and the second actuation of the button switch includes a pressing actuation.

6. A cooking appliance comprising:

a) heating means for heating food;

b) an actuator having at least first and second kinds of function of actuation, the first actuation selecting a cooking mode among plural kinds of cooking modes in a menu, and the second actuation commanding that the selected cooking mode be started; and c) means, responsive to the first and second actuations of the actuator, for setting the cooking modes among the plural kinds of cooking modes in the menu based on the first actuation of the actuator in the condition of the first actuation being held for a first predetermined period greater than a shortest possible actuation duration, and for determining the set cooking mode based on the second actuation, for resetting a new cooking mode after the first cooking mode is set when the first actuation is performed beyond a predetermined value of actuation, for controlling the heating means based on the reset cooking mode.

7. A method of operating a cooking appliance which includes heating means for heating food, an actuator having a first actuation and a second actuation, the first actuation selecting a cooking mode among plural kinds of cooking modes in a menu, and the second actuation commanding that the selected cooking mode be started, and the controlling means for controlling the heating means, comprising the steps of:

sensing the first actuation of the actuator to set a first cooking mode in plural kinds of menus, sensing the second actuation of the actuator, setting a new cooking mode different than the first cooking mode, without executing the first cooking mode, based on sensing the first actuation during a predetermined period, greater than a shortest possible actuation duration, after sensing the second actuation, and determining the new cooking mode after a predetermined period after stopping the performing the latter first actuation.

8. A method of operating a cooking appliance which includes heating means for heating food, an actuator having a first actuation and a second actuation, the first actuation selecting a cooking mode among plural kinds of cooking modes in a menu, and the second actuation commanding that the selected cooking mode be started, and the controlling means for controlling the heating means, comprising the steps of:

sensing a first actuation of the actuator to set a cooking mode among plural kinds from a menu, sensing a second actuation, indicating execution of the first actuation, being held for a predetermined period, greater than a shortest possible actuation, executing a selected cooking mode based on said sensing steps, resetting a new cooking mode by sensing the first actuator being moved beyond a predetermined value of actuation, and determining the new cooking mode upon sensing the second actuation.

* * * * *